US006992523B2

(12) United States Patent
Dake et al.

(10) Patent No.: US 6,992,523 B2
(45) Date of Patent: Jan. 31, 2006

(54) LOW VOLTAGE CURRENT MONITORING CIRCUIT

(75) Inventors: Luthuli Edem Dake, Richardson, TX (US); Jozef Adut, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 16 days.

(21) Appl. No.: 10/833,815

(22) Filed: Apr. 27, 2004

(65) Prior Publication Data

US 2005/0237087 A1 Oct. 27, 2005

(51) Int. Cl.
*G05F 1/10* (2006.01)
*G05F 3/02* (2006.01)

(52) U.S. Cl. ..... 327/538; 327/541; 323/312

(58) Field of Classification Search ..... 327/538, 327/539, 540, 541, 543; 323/313, 312, 315
See application file for complete search history.

(56) References Cited

U.S. PATENT DOCUMENTS

| | | | | |
|---|---|---|---|---|
| 3,963,931 A | | 6/1976 | Shapiro | 250/416 |
| 4,243,982 A | | 1/1981 | Yarbrough | 340/664 |
| 4,263,519 A | * | 4/1981 | Schade, Jr. | 327/539 |
| 5,248,287 A | * | 9/1993 | Nicoletti | 482/106 |
| 5,408,141 A | * | 4/1995 | Devore et al. | 327/541 |
| 5,568,045 A | * | 10/1996 | Koazechi | 323/314 |
| 5,621,601 A | * | 4/1997 | Fujihira et al. | 361/93.9 |
| 5,940,052 A | | 8/1999 | Xia et al. | 345/74 |
| 6,018,700 A | | 1/2000 | Edek | 702/60 |
| 6,150,872 A | * | 11/2000 | McNeill et al. | 327/539 |
| 6,677,808 B1 | * | 1/2004 | Sean et al. | 327/539 |

OTHER PUBLICATIONS

Fault Detection and Input Stimulus Determination for the Testing of Analog Integrated Circuits Based on Power-Supply Current Monitoring, Gielen et al, Department of Electrical Engineering, Katholieke Universiteit Leuven, 1994, pp 495-498.

(Continued)

*Primary Examiner*—Tuan T. Lam
(74) *Attorney, Agent, or Firm*—J. Dennis Moore; W. James Brady, III; Frederick J. Telecky, Jr.

(57) ABSTRACT

A current monitor (360) having a high performance, simple, and cost effective design that is independent of process, temperature and voltage is disclosed herein. The current monitor (360) includes a sensing transistor (340) that couples to the main transistor (312) of an adjoining voltage regulator. Specifically, the control and source nodes of each transistor couple to each other, respectively. The size of the main transistor (312) is a predetermined multiple integer n of the size of the sensing transistor. A first resistor ($R_{S3}$) couples between a supply voltage and the drain node of the main transistor (312). A second resistor ($R_{S1}$) couples between a supply voltage and the drain node of the sensing transistor (340), wherein the size of the second resistor ($R_{S1}$) is equal to the size of the first resistor ($R_{S3}$) multiplied by the predetermined multiple integer n. An inverting input of an amplifier (342) couples to the drain node of the sensing transistor (340), while a third resistor ($R_{S2}$) connects between the supply voltage and a non-inverting input of the amplifier (342). The amplifier (342) drives a transistor (344) within a closed feedback loop to equalize the value of the voltages at both inputs of the amplifier (342). A feedback resistor ($R_{fdb2}$) coupled between the source node of the transistor (344) and ground. A comparator (348) connects to the source node of the transistor (344) and between a current source and a reference resistor ($R_{ref}$) to provide an output voltage.

1 Claim, 2 Drawing Sheets

OTHER PUBLICATIONS

A Novel Wide-Band CMOS Current Amplifying Cell and Its Application in Power Supply Current Monitoring, Dragic et al., 2001 IEEE, pp 27-30.

Supply Current Monitor and Set-up for Fault Detection in Analogue Circuits, Mahmoud A. Al-Qutayri, 2002 IEEE, pp 441-444.

On-Chip Transient Current Monitor for Testing of Low-Voltage CMOS IC, Stopjakova et al.

Testing Linear Macros in Mixed-Signal Systems Using Transient Response Testing and Dynamic Supply Current Monitoring, Binns, et al,, Electronics Letters, Jul. 21, 1994 vol. 30. No. 15, pp 1216-1217.

Current Monitoring Technique for Testing Embedded Analogue Functions in Mixed Signal ICs, Robson et al., Electronics Letters, Apr. 25, 1996, vol. 32, No. 9, pp 796-798.

* cited by examiner

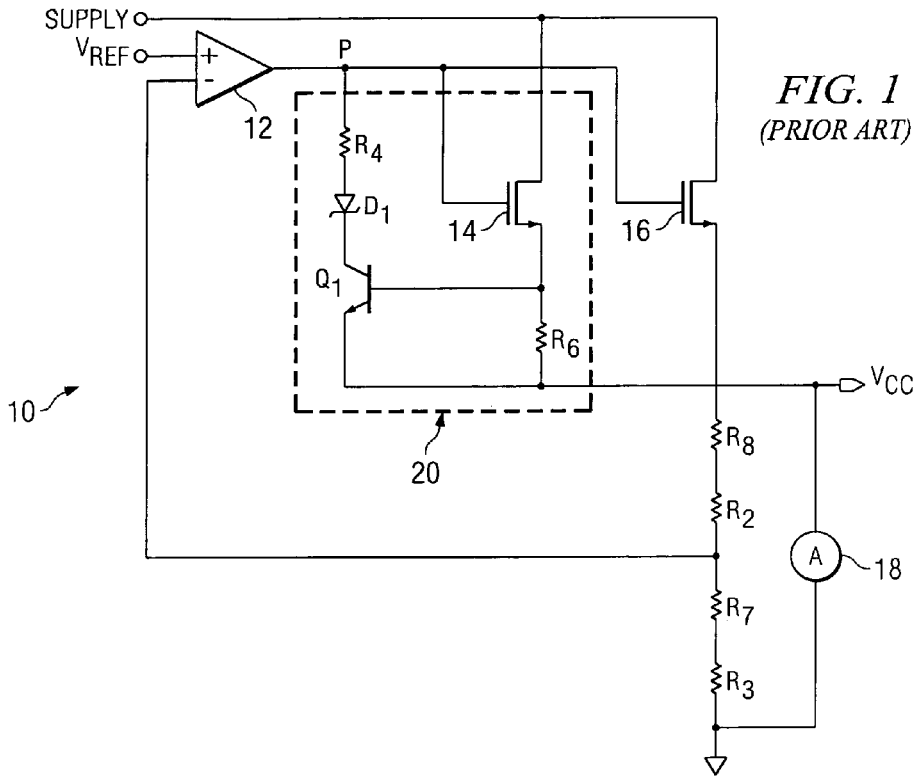
FIG. 1
(PRIOR ART)
FIG. 2
(PRIOR ART)
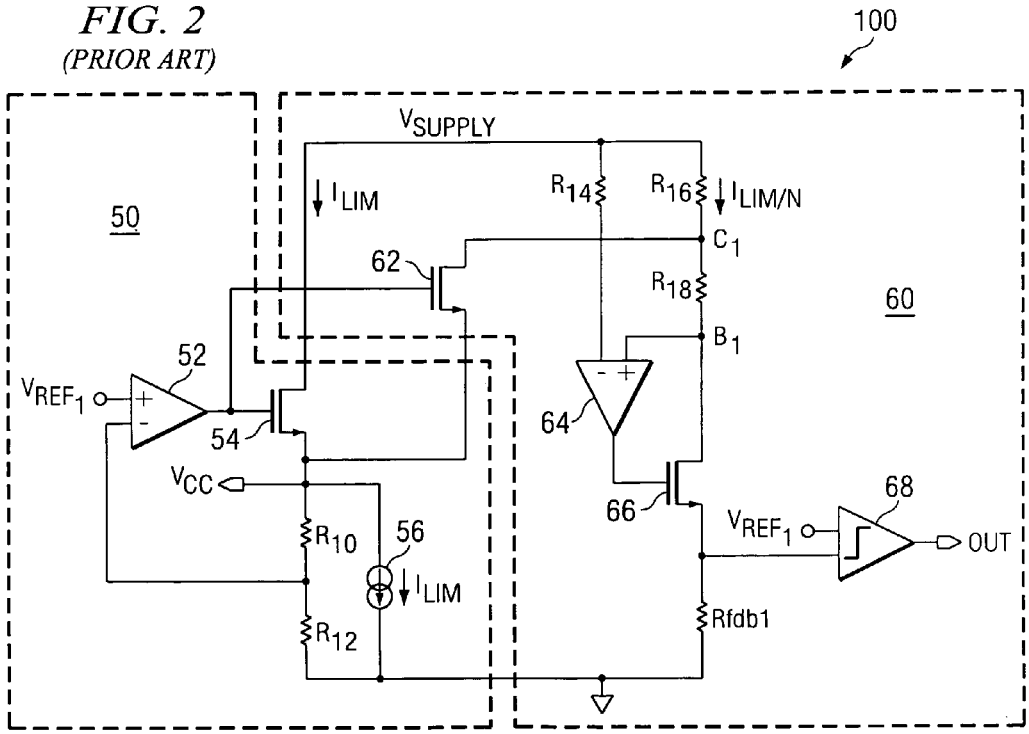

LOW VOLTAGE CURRENT MONITORING CIRCUIT

FIELD OF THE INVENTION

The present invention relates to current monitoring circuits, and, more particularly, to a low voltage current monitoring circuit that is independent of process, temperature and supply voltages even in high current and low voltage applications.

BACKGROUND OF THE INVENTION

Power-supply current monitoring for testing of CMOS logic circuits monitors the current passing through the power supply VDD or ground GND terminals during the application of an input stimulus or while the circuit is in a quiescent condition.

Many of the existing current monitors, however, fail to provide reliable monitoring due to fluctuation in process, temperature, and voltage supply.

FIG. 1 illustrates a voltage regulator arrangement connected to a current monitor 20. The voltage regulator includes a closed loop, wherein amplifier 12 couples to drive main FET 16. Main FET 16 is connected to a resistor divider represented by resistors $R_2$, $R_8$, $R_7$, and $R_3$. The connection from the voltage divider is fed back to the inverted input of amplifier, wherein the reference or bandgap voltage $V_{ref}$ is fed into the non-inverting input of the amplifier. The following equation applies when deriving the value of the generated voltage $V_{CC}$:

$$V_{CC}=V_{ref}(1+(R_8+R_2)/(R_7+R_3))$$

The current monitor 20 includes a sense FET 14, having a control node, a source node and a drain node, a resistor $R_6$, a transistor $Q_1$, a diode $D_1$, and a resistor $R_4$. The control node of sense FET 14 connects to amplifier 14. In operation, the current that goes through the sense FET 14 is divided down by n since the size of sense FET 14 is 1/n times the size of the main FET 16, where n is some integer value (i.e. 2, 3, 4, etc.). This same current flows across resistor $R_6$ and generates a voltage that is equivalent to the base emitter voltage of transistor $Q_1$. Once the voltage across resistor $R_6$ is greater than the quiescent threshold voltage (~0.7V) of transistor $Q_1$, transistor $Q_1$ turns on. As a result, node P is pulled down and, thereby, the main FET 16 is turned off. Accordingly, excess current is prevented from flowing through main FET 16 after the threshold is reached.

Problems arise when the variations of process, temperature, voltage of the main FET 16, sense FET 14, and resistor $R_6$ cause the voltages to vary and, thereby, creating voltage mismatches within the circuit. If the drain-to-source voltage $V_{DS}$ across main FET 16 and sense FET 14 do not match, the basic equation for the generating voltage $V_{CC}$ will be defeated.

FIG. 2 shows another known current monitor 60 connected to sense the current of voltage regulator 80. The voltage regulator 80 includes amplifier 52 coupled to the gate of the main FET 54. The drain of the main FET 54 connects to resistors $R_{10}$ and $R_{12}$ which form a voltage divider to be fed back to the inverting input of amplifier 10. In operation, the voltage regulator incorporates a closed loop using amplifier 52 which drives main FET 54. The main FET 54 is connected to a voltage divider represented by resistors, $R_{10}$ and $R_{12}$. The connection from the voltage divider is fed back to the inverted input of amplifier 52, where the reference or bandgap voltage $V_{ref}$ is fed into the non-inverting input of amplifier 52. The following equation applies when deriving the value of $V_{CC}$:

$$V_{CC}=V_{ref}(1+(R_{10})/(R_{12}))$$

Current monitor 60 includes a sense FET 62 coupled to an amplifier 64 that includes a feedback loop. Since the feedback loop exists, the voltage at node $B_1$ is controlled. It is necessary to make certain that the voltage at node $A_1$ equals the voltage at node $B_1$. The current $I_{lim}/n$ represents the feedback current $i_{fdb}$ that flows through resistor $R_{16}$. The voltage at node $C_1$ is represented in the following equation:

$$V_{node\ C1}=V_{supply}-R_{16}(I_{lim}/n).$$

Amplifier 64 controls transistor 66 such that the current through resistors, $R_{16}$ and $R_{18}$, changes to make sure that the voltage at nodes $A_1$ and $B_1$ remain the same.

In operation, if the voltage at node $B_1$ is greater than the voltage at node $A_1$ by for example 100 mV, the gate voltage of transistor 66 will rise since the gate to source voltage will increase. Initially transistor 66 is in the saturation region, once the gate to source voltage $V_{gs}$ increases, the feedback current $i_{fdb}$ will decrease to try to match and make the voltage at node $A_1$ equivalent to that of node $B_1$, such that the voltage at node $B_1$ will decrease to equalize to that of node $A_1$.

When the voltage at node $A_1$ is greater than that of node $B_1$, however, the current that flows through transistor 66 will decrease and the feedback current $i_{fdb}$ will increase to try to match and force transistor 66 into the saturation region. Thereby, the voltage at node $B_1$ will increase to that of node $A_1$.

Problems arise when the transistors process varies, thereby the voltage and current values will differ. In addition, when the temperature and supply voltage changes, this type of current monitor fails to provide a reliable determination due to drain-to-source voltage mismatch of main FET 54 and sense FET 62.

Thus, a need exists for a current monitor having a high performance, simple, and cost effective design that is independent of process, temperature and voltage.

The present invention is directed to overcoming, or at least reducing the effects of one or more of the problems set forth above.

SUMMARY OF THE INVENTION

To address the above-discussed deficiencies of current monitors, the present invention teaches a current monitor having a high performance, simple, and cost effective design that is independent of process, temperature and voltage. The current monitor includes a sensing transistor that couples to the main transistor of an adjoining voltage regulator. Specifically, the control and source nodes of each transistor couple to one another, respectively. The size of the main transistor is a predetermined multiple integer n of the size of the sensing transistor. A first resistor couples between a supply voltage and the drain node of the main transistor. A second resistor couples between a supply voltage and the drain node of the sensing transistor, wherein the size of the second resistor is equal to the size of the first resistor multiplied by the predetermined multiple integer n. An inverting input of an amplifier couples to the drain node of the sensing transistor, while a third resistor connects between the supply voltage and a non-inverting input of the amplifier. A control node of a transistor connects to the output of the amplifier. A drain node of the transistor feeds back to the noninverting input of the amplifier. A feedback resistor coupled between the source node of the transistor and ground. A current source coupled to the supply voltage. A first input of a comparator connects to the current source, while the second input of a comparator couples to the source node of the transistor. A reference resistor connects between the first input of the comparator and ground.

These and other features and advantages of the present invention will be understood upon consideration of the following detailed description of the invention and the accompanying drawings.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein:

FIG. 1 illustrates a known voltage regulator and current monitor arrangement;

FIG. 2 display another known voltage regulator and current monitor arrangement.

DETAILED DESCRIPTION OF PREFERRED EMBODIMENTS

Figure 3:
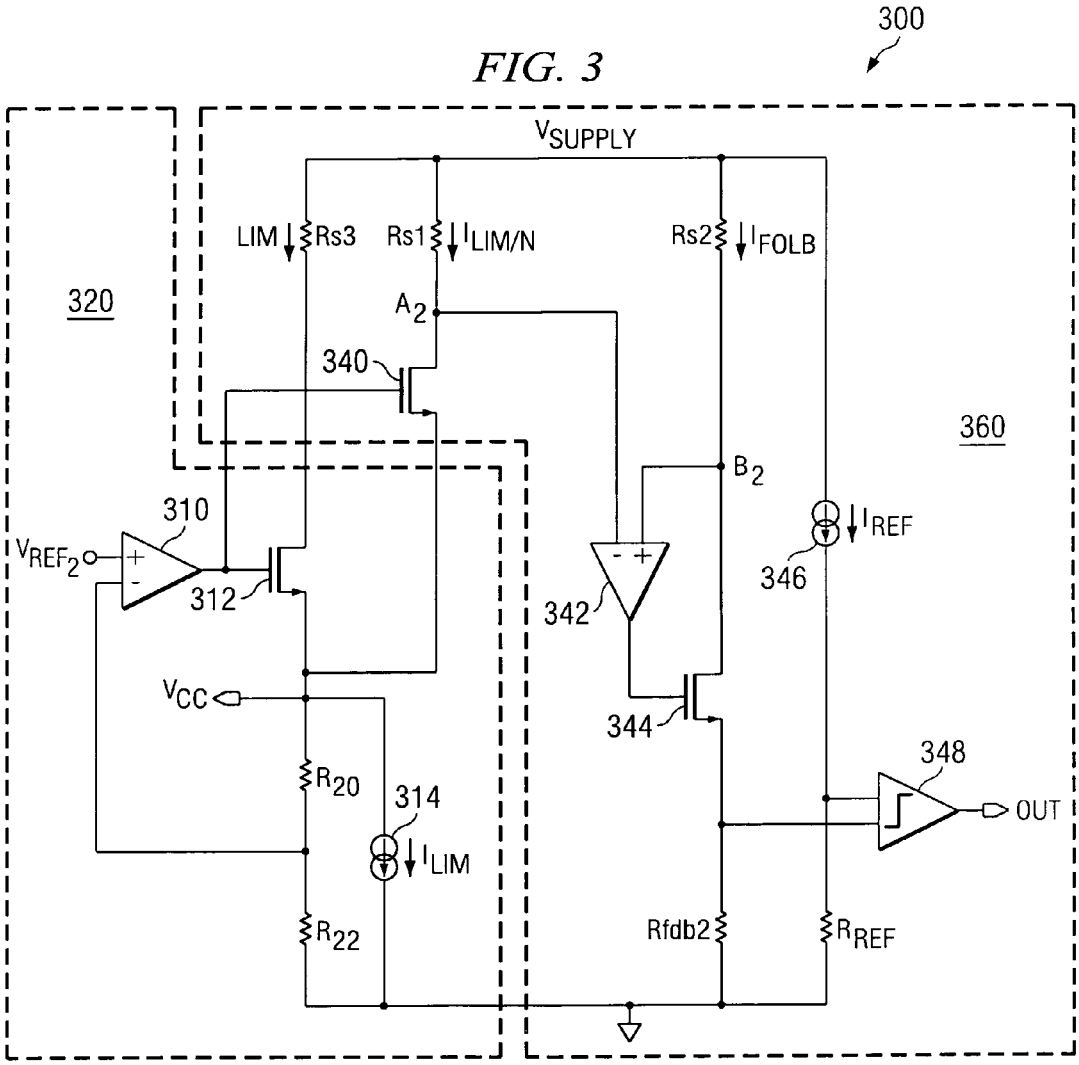
FIG. 3 shows voltage regulator and current monitor arrangement in accordance with the present invention.

The present invention will now be described more fully hereinafter with reference to the accompanying drawings, in which embodiments of the invention are shown. This invention may, however, be embodied in many different forms and should not be construed as limited to the embodiments set for the herein. Rather, these embodiments are provided so that this disclosure will be thorough and complete, and will fully convey the scope of the invention to those skilled in the art.

FIG. 3 illustrates a voltage regulator 320 and the novel current monitor 360 arrangement in accordance with the present invention. The voltage regulator 320 includes amplifier 310 coupled to the gate of the main FET 312. The drain of the main FET 312 connects to resistors $R_{10}$ and $R_{12}$ which form a voltage divider to be fed back to the inverting input of amplifier 310. In operation, the voltage regulator incorporates a closed loop using amplifier 310 which drives main FET 312. The main FET 312 is connected to a voltage divider represented by resistors, $R_{20}$ and $R_{22}$. The connection from the voltage divider is fed back to the inverted input of amplifier 310, where the reference or bandgap voltage $V_{ref}$ is fed into the non-inverting input of amplifier 310. The following equation applies when deriving the value of $V_{CC}$:

$$V_{CC}=V_{ref}(1+(R_{20})/R_{22}))$$

Within current monitor 360, it is necessary that the voltage drop across resistor $R_{S3}$ is equal to the voltage drop across resistor $R_{S1}$. Since amplifier 342 coupled to transistor 344 forms a feedback loop, the voltage is controlled. It is necessary to make certain that the voltage at node $A_2$ equals the voltage at node $B_2$. The current Ilim/n represents the current that flows through resistor $R_{S1}$. The voltage at node $A_2$ is represented in the following equation:

$$V_{node\ A}=V_{supply}-R_{S1}(I_{lim}/n).$$

The amplifier 342 controls transistor 344 such that the current through resistor $RS_2$ changes to make sure that the voltage at nodes $A_2$ and $B_2$ remain the same.

A drain-to-source voltage $V_{DS}$ offset cancellation is implemented by placing a resistor $R_{S3}$ in series with the main FET 312 which tracks the $V_{DS}$ between the main FET 312 and the sense FET 340. The size of sense FET 340 is a predetermined multiple n of the size of the main FET 312. Thereby, the size of resistor $R_{S3}$ is equal to resistor $R_{S1}$/n. The current that flows across resistor $R_{S3}$ is $I_{lim}$, while the current that flows across resistor $R_{S1}$ is $I_{lim}$/n. Thereby, even when the battery voltage varies, it will not affect the matching between the main FET 312 and the sense FET 340. It is important that the same amount of current must not flow through the sense FET 340 that flows through the main FET 312 or current will be wasted. The novel implementation decrements the current through the sense FET 340 by a factor of 1/n. This ratio will be constant with temperature, process, and voltage variation.

In operation, if the voltage at node $B_2$ is greater than the voltage at node $A_2$ by for example 100 mV, the gate voltage of transistor 344 will rise, since the gate to source voltage will increase. Initially transistor 344 is in the saturation region, once the gate-to-source voltage $V_{gs}$ increases, the feedback current $i_{fdb}$ will decrease to try to match and make the voltage at node $A_2$ equivalent to that of node $B_2$, such that the voltage at node $B_2$ will decrease to equalize that of node $A_2$.

When the voltage at node $A_2$ is greater that that of node $B_2$, however, the current that flows through transistor 344 will decrease and the feedback current $i_{fdb}$ will increase to try to match and make the saturation region. Thereby, the voltage at node $B_2$ will increase to that of node $A_2$.

Those of skill in the art will recognize that the physical location of the elements illustrated in FIG. 3 can be moved or relocated while retaining the function described above.

Advantages of this design include but are not limited to a current monitor having a high performance, simple, and cost effective design that is independent of process, temperature and voltage.

The reader's attention is directed to all papers and documents which are filed concurrently with this specification and which are open to public inspection with this specification, and the contents of all such papers and documents are incorporated herein by reference.

All the features disclosed in this specification (including any accompany claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

We claim:

1. A current monitor, wherein the current monitor connects to a voltage regulator having a main transistor, the main transistor having a control node, a source node and a drain node, the current monitor comprising:

a sensing transistor having a control node, a source node and a drain node, the control node coupled to the control node of the main transistor to sense the current and voltage of the voltage regulator, the source node coupled to the source node of the main transistor within the voltage regulator, wherein the size of the main transistor is a predetermined multiple integer n of the size of the sensing transistor;

a first resistor coupled between a supply voltage and the drain node of the main transistor;

a second resistor coupled between a supply voltage and the drain node of the sensing transistor, wherein the size of the first resistor is equal to the size of the second resistor divided by the predetermined multiple integer n;

an amplifier, having an inverting input, a noninverting input, and an output, the inverting input coupled to the drain node of the sensing transistor;

a third resistor coupled between the supply voltage and the noninverting input of the amplifier;

a transistor having a control node, a source node and a drain node, the control node coupled to the output of the amplifier, the drain node coupled to the noninverting input of the amplifier;

a feedback resistor coupled between the source node of the transistor and ground;

a current source coupled to the supply voltage;

a comparator, having a first input, a second input and an output, the first input coupled to the current source, the second input coupled to the source node of the transistor; and a reference resistor coupled between the first input of the comparator and ground.

* * * * *